US005383515A

United States Patent [19]

Grocock et al.

[11] Patent Number: 5,383,515

[45] Date of Patent: Jan. 24, 1995

[54] TWIN ROLL CASTING

[75] Inventors: Peter G. Grocock, Wareham; Philip M. Thomas, West Moors, both of England

[73] Assignee: Davy McKee (Poole) Limited, Dorset, England

[21] Appl. No.: 971,762

[22] PCT Filed: Aug. 2, 1991

[86] PCT No.: PCT/GB91/01323

§ 371 Date: Mar. 2, 1993

§ 102(e) Date: Mar. 2, 1993

[87] PCT Pub. No.: WO92/02320

PCT Pub. Date: Feb. 20, 1992

[30] Foreign Application Priority Data

Aug. 3, 1990 [GB] United Kingdom ..... 9017042

[51] Int. Cl.[6] ..... B22D 11/06

[52] U.S. Cl. ..... 164/480; 164/428

[58] Field of Search ..... 164/480, 428, 452, 154.1

[56] References Cited

U.S. PATENT DOCUMENTS 4,501,315 2/1985 Bercovici ..... 164/413 X 4,979,556 12/1990 Braun et al. ..... 164/428 X

FOREIGN PATENT DOCUMENTS 1-218745 8/1989 Japan ..... 164/428

OTHER PUBLICATIONS

English translation of Japanese patent publication 1-218745.

*Primary Examiner*—J. Reed Batten, Jr.

*Attorney, Agent, or Firm*—Lee, Mann, Smith, McWilliams, Sweeney & Ohlson

[57] ABSTRACT

Molten light metal alloy is introduced through a nozzle into the gap between a pair of counter-rotating cooled cylindrical rolls. The longitudinal axes of the rolls are in parallel planes but are inclined to each other so that the rolls apply scrubbing forces to the opposite faces of the strip produced by solidifying the metal. The scrubbing action is sideways to the direction of movement of the strip and prevents the strip from sticking to the rolls.

2 Claims, 3 Drawing Sheets

TWIN ROLL CASTING

This invention relates to the casting of light metal alloys by the twin roll casting process.

In this known process, molten light metal alloy is introduced into the bite between two cooled rotating rolls. Where the liquid metal comes into contact with the rolls, a skin is formed and this skin, which rapidly thickens, undergoes hot working before finally emerging from between the two rolls in the form of a strip. During the hot working of the material, the cast material initially is extruded towards the liquid metal feed because the strip is moving more slowly than the surface of the adjacent rolls. Where the strip is extruded from the roll bite, it leaves the machine at a greater velocity than the peripheral surface of the adjacent rolls and this is known as "forward extrusion". There is a neutral point between the entry side of the molten metal and the exit side of the strip where the movement of the strip is equal to the peripheral speed of the adjacent rolls. It is usual for both of the rolls, which are of the same diameter, to be driven from a common source and thus both roll surfaces have the same peripheral speed. In these circumstances the neutral point is in the same position for each of the two rolls.

One of the problems encountered in twin roll casting of light metal alloys is sticking of the casting to one or other of the rolls. In general, sticking becomes a greater problem as the thickness of the workpiece being cast is reduced. When casting workpieces of a thickness of, say, less than 2.5 mm, sticking of the casting to one or other of the rolls can become very critical.

It is an object of the present invention to provide a method of roll casting in which the problem of sticking of light metal alloy is at least reduced, if not entirely eliminated.

According to the present invention, in a method of casting a light metal alloy to form a strip, molten light metal alloy is introduced by way of a nozzle assembly into the gap between a pair of cooled rolls which are rotated to roll the solidfying metal into strip, characterised in that action is taken to prevent the strip from sticking to either of the rolls, said action comprising arranging the rolls to have their axes of rotation in parallel planes but inclined to each other thereby causing scrubbing forces to be applied to the opposite faces of the strip by the rolls, said scrubbing forces being sideways to the direction of movement of the strip out of the roll gap.

It is well established in the art of metal rolling that the profile of the material being rolled can be controlled by crossing the mill rolls. However, in the twin roll casting process, the profile of the cast strip is readily controlled by means other than by crossing the rolls.

In the method of the present invention, roll crossing is used to prevent sticking of the cast strip to either or both of the caster rolls.

By crossing the rolls of a twin roll caster, a scrubbing action is generated between the cast strip and the rolls independently of any forward extrusion and a slip force is applied to each surface of the cast strip. This additional force is perpendicular to the direction of movement of the strip in the plane of the strip and serves to generate a sideways scrubbing action between the surface of the strip and the rolls, thus preventing the strip material from sticking to the rolls. It has been found that-sticking can be avoided if the forward slip (or extrusion) is greater than typically 5%. This amount of relative movement can be achieved by crossing the caster rolls by approximately 6 degrees.

One or both of the rolls can be displaced by means of actuators which act between the chocks at the ends of the roll and the rigid housing of the caster. Although the position of the rolls can be altered once casting has commenced, it is more likely that the roll(s) will be displaced to the crossed position prior to the commencement of casting and held in that position during casting. The angle of crossing of the rolls is dependent on the casting condition, inter alia, the alloy being cast.

In order that the invention may be more readily understood, it will now be described, by way of example only, with reference to the accompany drawings, in which.

Figure 4A:
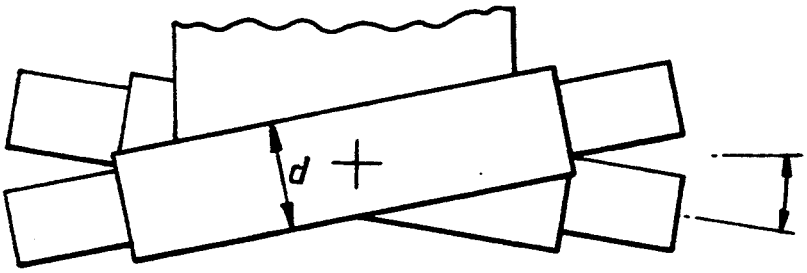
Figure 4B:
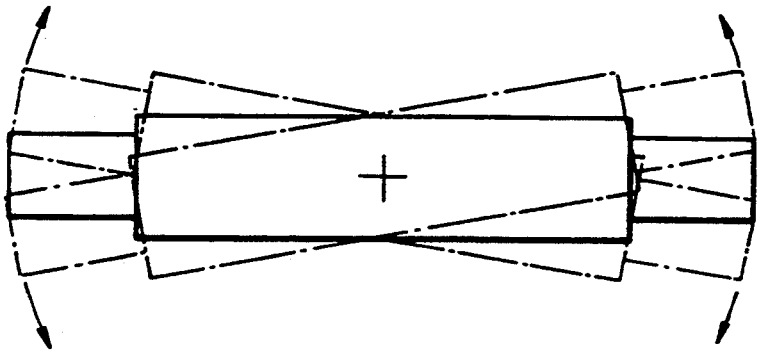
Figure 4C:
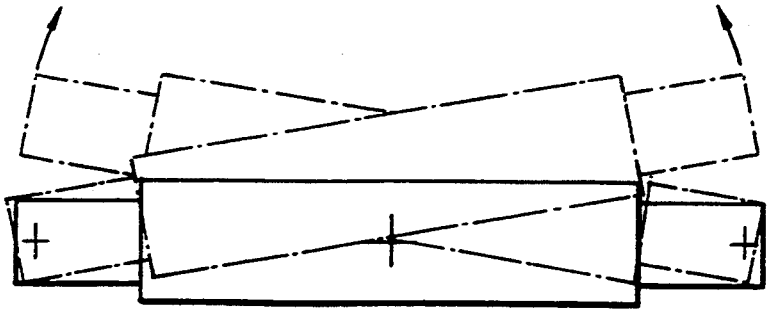

FIGS. 4*a*–4*c* indicate the crossing of the rolls of the caster.

Figure 1:
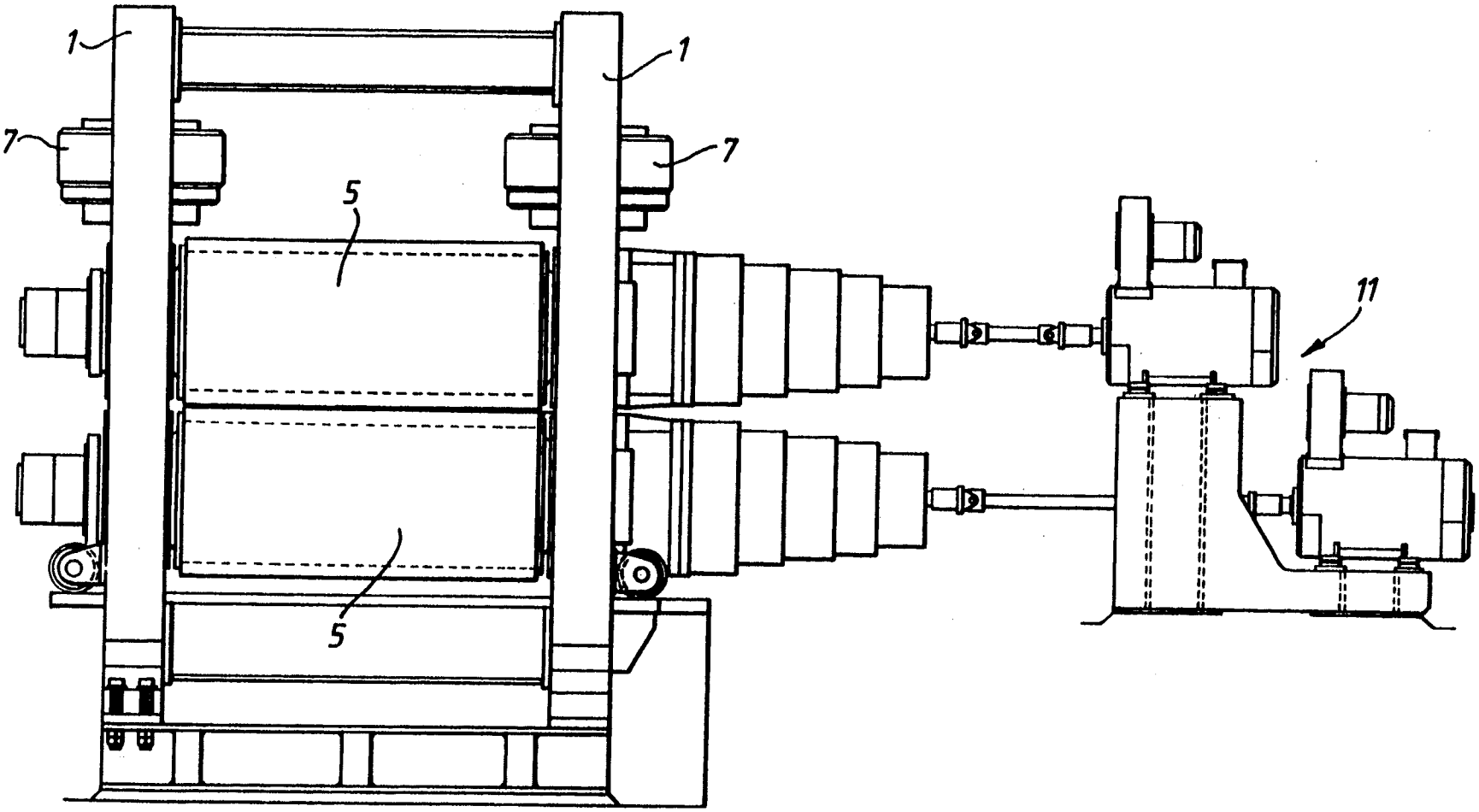
FIG. 1 is side elevation of a twin roll caster.
Figure 2:
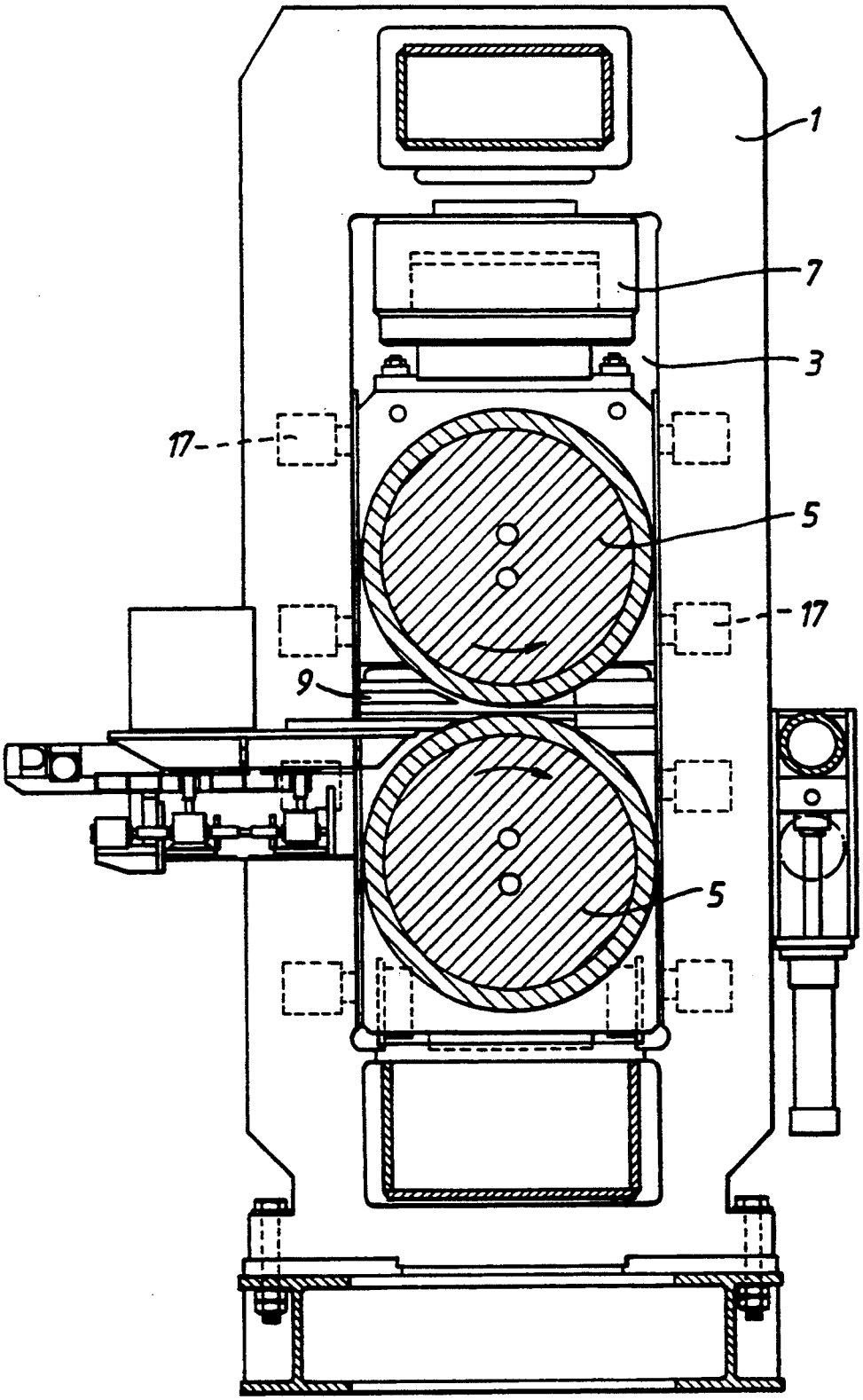
FIG. 2 is sectional end elevation of the caster shown in FIG. 1.

Referring particularly to FIGS. 1 and 2, a twin roll caster comprises a pair of spaced apart housings 1, each of which defines a window 3. A pair of rolls 5 are supported at their ends in bearing chock assemblies which are located in the housing windows 3 so that the two rolls are arranged One above the other. Means (not shown) are provided for circulating cooling fluid through the rolls. Roll gap adjustment means 7 are provided in each housing window to raise and lower the upper roll so as to adjust the gap between the two rolls. A nozzle assembly 9 serves to introduce molten metal into the gap between the rolls and the molten metal coming into contact with the cooled rolls forms a pair of skins and these skins, which rapidly thicken, undergo hot working before finally emerging from between the two rolls in the form of a metal strip. The rolls are rotated by drive means 11 which may be a common drive but, preferably, each roll is driven from a separate drive motor, as shown in FIG. 1. This enables rolls of different diameters to be used and for the speed of rotation of one roll to be adjusted relative to that of the other, if this becomes necessary.

In a conventional twin roll caster, the axes of rotation of the two rolls are in parallel planes and are parallel with each other.

Figure 3:
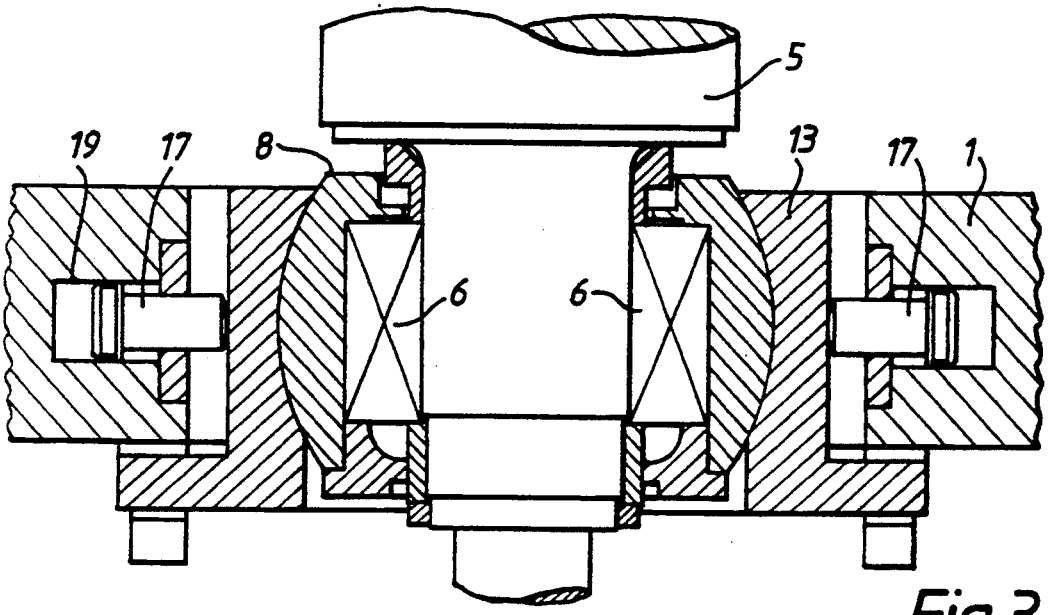
FIG. 3 is a detail of one end of a roll of the caster.

Referring now to FIG. 3, one of the rolls 5 has its roll end supported in bearings 6 mounted in a thrust bearing cage 8 having a part spherical outer surface. The cage is mounted in a chock assembly 13 which has a width which is less than the width of the window in the housing 1. A pair of fluid operable actuators 17 are located in recesses 19 in the housing 1, on each side of the window. The actuators, when energised, engage the opposite sides of the chock assembly 13. The line of action of each actuator is substantially normal to the axis of rotation of the roll. Although not shown each roll has means to resist end thrust.

In order to cross the rolls two modes may be employed.

As shown in FIGS. 4*a* and 4*b*, each roll having a diameter d is displaced by an equal lateral movement of the bearing chocks at each end of the roll by operation of the actuators with the lateral movement at one end being in the opposite direction to the lateral movement at the opposite end and, in this way, each roll pivots about its centre.

In the arrangement shown in FIG. 4c, however, the bearing chock assembly at the right-hand end of, say, the top roll is displaced in one direction by the actuators while the bearing chock at the other end of the roll is not displaced. At the same time, the bearing chock assembly at the left-hand end of the lower roll is displaced by the actuators while the opposite end of the lower roll is not displaced and, in that way, each roll pivots about one end but the two rolls are pivoted about opposite ends.

In all embodiments of the invention it is convenient for the rolls to be displaced so that they are inclined to each other at an angle of between 2 and 10 degrees, about 6 degrees being the most usual.

Although the actuators can be operated during casting in order to adjust the angle of inclination between the two rolls, it is more usual to incline the rolls prior to casting and to operate the caster with the rolls at a fixed mutual inclination.

We claim:

1. A method of casting a light metal alloy to form a strip comprising the steps of:

arranging a pair of cylindrical cooled rolls with their longitudinal axes inclined to each other but in parallel planes and with a gap between the rolls;

introducing molten light metal alloy through a nozzle into the gap between the rolls;

counter-rotating the rolls about their longitudinal axes to roll the metal which solidifies in contact with the rolls into a strip having a pair of opposite faces which exits from the roll gap;

said rolls causing scrubbing forces to be applied to the opposite faces of the strip said forces being sideways to the direction of movement of the strip out of the gap between the rolls to prevent the strip from sticking to either of the rolls.

2. A method as claimed in claim 1, in which the rolls are inclined to each other by about 6 degrees.

* * * * *